US009065255B2

(12) United States Patent
Sakayanagi et al.

(10) Patent No.: US 9,065,255 B2
(45) Date of Patent: Jun. 23, 2015

(54) SPARK PLUG AND METHOD OF MANUFACTURING THE SAME

(71) Applicant: NGK SPARK PLUG CO., LTD., Nagoya (JP)

(72) Inventors: Nobuaki Sakayanagi, Toyohashi (JP); Shinya Mitsuda, Inuyama (JP); Tomoaki Kato, Nagoya (JP); Ryuichi Ono, Niwa-gun (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 13 days.

(21) Appl. No.: 13/847,770

(22) Filed: Mar. 20, 2013

(65) Prior Publication Data

US 2013/0278133 A1 Oct. 24, 2013

(30) Foreign Application Priority Data

Mar. 23, 2012 (JP) ..... 2012-067231
Aug. 30, 2012 (JP) ..... 2012-190296

(51) Int. Cl.
*H01T 13/20* (2006.01)
*H01T 21/02* (2006.01)
*H01T 13/32* (2006.01)

(52) U.S. Cl.
CPC ..... *H01T 13/32* (2013.01); *H01T 21/02* (2013.01)

(58) Field of Classification Search
CPC ..... H01T 13/32
USPC ..... 313/118–145
See application file for complete search history.

(56) References Cited

U.S. PATENT DOCUMENTS

2002/0063504 A1 5/2002 Hori
2009/0284118 A1* 11/2009 Tinwell ..... 313/141
2010/0133977 A1 6/2010 Kato
2011/0241522 A1 10/2011 Quitmeyer

FOREIGN PATENT DOCUMENTS

JP 2002-222686 A 8/2002
JP 2005-50746 A 2/2005
JP 5027156 B2 6/2012

* cited by examiner

*Primary Examiner* — Anh Mai
*Assistant Examiner* — Zachary J Snyder
(74) *Attorney, Agent, or Firm* — Leason Ellis LLP

(57) ABSTRACT

A spark plug includes: a rod-shaped center electrode extending in an axial direction; an insulator including a shaft hole that holds the center electrode inside of the shaft hole; a metal shell surrounding and holding a part of the insulator; and a ground electrode including a base end welded to the metal shell. The metal shell and the ground electrode are joined via a fusion portion formed by welding the ground electrode and the metal shell together. When the smallest thickness of the fusion portion in the axial direction is A, when, in a cross section that includes a center line of the ground electrode and is parallel to the axis, a length of a ground-electrode-side melted boundary formed between the fusion portion and the ground electrode is B, and when the ground electrode thickness is C, conditions of A≥0.2 mm and B>C are satisfied.

9 Claims, 19 Drawing Sheets

FIG. 6

| No. | WELDING METHOD | THICKNESS A (mm) | LENGTH B (EP2-FP1-EP4) (mm) | THICKNESS C (mm) | EVALUATION |
|---|---|---|---|---|---|
| 1 | RESISTANCE WELDING | - | 1.5 | 1.5 | NORMAL |
| 2 | RESISTANCE WELDING | - | 2.5 | 2.5 | NORMAL |
| 3 | LASER BEAM WELDING | 0.1 | 1.5 | 1.5 | NORMAL |
| 4 | LASER BEAM WELDING | 0.2 | 1.5 | 1.5 | NORMAL |
| 5 | LASER BEAM WELDING | 0.1 | 1.7 | 1.5 | NORMAL |
| 6 | LASER BEAM WELDING | 0.2 | 1.7 | 1.5 | GOOD |
| 7 | LASER BEAM WELDING | 0.2 | 2.0 | 1.5 | GOOD |
| 8 | LASER BEAM WELDING | 0.2 | 2.5 | 1.5 | GOOD |

FIG. 7

| No. | WELDING METHOD | LENGTH B (EP2-FP1-EP4) (mm) | FOLDING POINT | EVALUATION |
|---|---|---|---|---|
| 6 | LASER BEAM WELDING | 1.7 | NOT EXIST | GOOD |
| 8 | LASER BEAM WELDING | 2.5 | NOT EXIST | GOOD |
| 9 | LASER BEAM WELDING | 1.7 | EXIST | EXCELLENT |
| 10 | LASER BEAM WELDING | 2.5 | EXIST | EXCELLENT |

FIG. 8

| No. | WELDING METHOD | LENGTH B (EP2-FP1-EP4) (mm) | LENGTHS D AND E OF FUSION PORTION | EVALUATION |
|---|---|---|---|---|
| 9 | LASER BEAM WELDING | 1.7 | D > E | EXCELLENT |
| 10 | LASER BEAM WELDING | 2.5 | D > E | EXCELLENT |
| 11 | LASER BEAM WELDING | 1.7 | D < E | GOOD |
| 12 | LASER BEAM WELDING | 2.5 | D < E | GOOD |

FIG. 9

| No. | WELDING METHOD | LENGTH B (EP2-FP1-EP4) (mm) | THICKNESSES F AND G | THICKNESS A (mm) | EVALUATION |
|---|---|---|---|---|---|
| 13 | LASER BEAM WELDING | 2.5 | F > G | 0.2 | GOOD |
| 14 | LASER BEAM WELDING | 2.5 | F < G | 0.2 | NORMAL |

FIG. 11

| No. | WELDING METHOD | LENGTH H (EP1-FP2-EP3) (mm) | FOLDING POINT | EVALUATION |
|---|---|---|---|---|
| 15 | LASER BEAM WELDING | 1.7 | NOT EXIST | GOOD |
| 16 | LASER BEAM WELDING | 1.7 | EXIST | EXCELLENT |
| 17 | LASER BEAM WELDING | 2.5 | NOT EXIST | GOOD |
| 18 | LASER BEAM WELDING | 2.5 | EXIST | EXCELLENT |

FIG. 13

| No. | WELDING METHOD | LENGTH H (EP1 - (FOLDING POINT) - EP3) (mm) | NUMBER OF FOLDING POINTS | EVALUATION |
|---|---|---|---|---|
| 19 | LASER BEAM WELDING | 2.5 | 0 | NORMAL |
| 20 | LASER BEAM WELDING | 2.5 | 1 | GOOD |
| 21 | LASER BEAM WELDING | 2.5 | 2 | EXCELLENT |
| 22 | LASER BEAM WELDING | 2.5 | 3 | EXCELLENT |

FIG. 16

| SHAPE OF FUSION PORTION AT GROUND-ELECTRODE-SIDE BOUNDARY | OXIDE FILM THICKNESS Tof | DETERMINATION |
|---|---|---|
| FLAT | 0.17 mm | POOR |
| CONVEX TO METAL SHELL SIDE | 0.06 mm | GOOD |
| CONCAVE TO GROUND ELECTRODE SIDE | 0.13 mm | POOR |

FIG. 19

| SHAPE OF FUSION PORTION AT GROUND-ELECTRODE-SIDE BOUNDARY | CRACK OCCURRENCE |
|---|---|
| FLAT | OCCUR |
| CONVEX TO METAL SHELL SIDE | NOT OCCUR |
| CONCAVE TO GROUND ELECTRODE SIDE | OCCUR |

SPARK PLUG AND METHOD OF MANUFACTURING THE SAME

This application claims the benefit of Japanese Patent Applications No. 2012-067231, filed Mar. 23, 2012 and No. 2012-190296, filed Aug. 30, 2012, all of which are incorporated by reference in their entirety herein.

FIELD OF THE INVENTION

The present invention relates to a spark plug used for an internal combustion engine.

BACKGROUND ART OF THE INVENTION

A spark plug used for an internal combustion engine includes a metal shell and a ground electrode. The ground electrode includes a base end welded to the metal shell. A general welding method is resistance welding.

PRIOR ART DOCUMENT

Patent Document

Patent Document 1 JP 2002-222686 A
Patent Document 2 JP 2005-50746 A
Patent Document 3 JP 2008-550585 A

Problem to be Solved by the Invention

However, nowadays, usage environment requirements on a spark plug in an internal combustion engine has become severe. Accordingly, a spark plug that withstands a high-temperature condition and a high-load condition is desired compared with before, Therefore, improvement in the bonding durability between the ground electrode and the metal shell is desired.

Means for Solving the Problems

The present invention has been conceived to solve at least a part of the above-mentioned problems, and can be achieved as the following embodiments or application examples.

SUMMARY OF THE INVENTION

Application Example 1

A spark plug includes a rod-shaped center electrode, an insulator, a metal shell, and a ground electrode. The rod-shaped center electrode extends in an axial direction. The insulator includes a shaft hole that extends in the axial direction. The insulator holds the center electrode inside of the shaft hole. The metal shell surrounds and holds a part of the insulator in a circumferential direction. The ground electrode includes a base end welded to the metal shell. The metal shell and the ground electrode are joined via a fusion portion. The fusion portion is formed by melting both the ground electrode and the metal shell together using welding. The base end of the ground electrode includes an end face melted entirely. In a thickness of the fusion portion in the axial direction, a thickness of a portion with a smallest thickness is assumed to be A. In a cross section that includes a center line of the ground electrode and the axis and is parallel to the axis, a length of a ground-electrode-side melted boundary is assumed to be B. The melted boundary is a boundary between the fusion portion and the ground electrode. A thickness of the ground electrode is assumed to be C. In this case, the conditions of $A \geq 0.2$ mm and $B > C$ are satisfied.

The spark plug in this configuration ensures the fusion portion with a thickness equal to or more than a predetermined thickness. Additionally, the length of the boundary between the ground electrode and the fusion portion is larger than the thickness of the ground electrode. This improves a welding strength between the ground electrode and the metal shell. As a result, this improves the durability of the joint between the ground electrode and the metal shell.

Application Example 2

In the spark plug described in application example 1, in the cross section, a shape of the ground-electrode-side melted boundary includes any of a curved line, a plurality of straight lines, and a combination of a curved line and a straight line.

The spark plug with this configuration can disperse the direction of stress acting at the ground-electrode-side melted boundary due to vibration generated during use of the spark plug. Accordingly, this improves bonding durability between the ground electrode and the metal shell of the spark plug in use.

Application Example 3

In the spark plug described in application example 1 or 2, in the cross section, the condition of $D > E$ is satisfied in the following cases. At a boundary between the fusion portion and the metal shell as a metal-shell-side melted boundary, a length between a first end point and a second end point in an axial direction is assumed to be D. The first end point is an end point on an opposite side of the center electrode. The second end point is an end point on an opposite side of the center electrode at the ground-electrode-side melted boundary. A length between a third end point and a fourth end point in the axial direction is assumed to be E. The third end point is an end point at the center electrode side at the metal-shell-side melted boundary. The fourth end point is an end point at the center electrode side at the ground-electrode-side melted boundary.

The spark plug in use is exposed to a relatively high temperature condition on the opposite side of the center electrode in the ground electrode. The spark plug of the application example 3 forms the fusion portion relatively larger at the side exposed to the high temperature condition. Accordingly, this improves bonding durability between the ground electrode and the metal shell of the spark plug in use.

Application Example 4

In the spark plug described any one of application examples 1 to 3, in the cross section, a shape of the metal-shell-side melted boundary as the boundary between the fusion portion and the metal shell includes any of a curved line, a plurality of straight lines, and a combination of a curved line and a straight line.

With the spark plug of the application example 4, the shape of the metal-shell-side melted boundary as the boundary between the fusion portion and the metal shell may include any of a curved line, a plurality of straight lines, and a combination of a curved line and a straight line. This enlarges the area of the interfacial boundary between the fusion portion and the metal shell, that is, the contact area between the fusion portion and the metal shell compared with the case where the metal shell and the fusion portion are formed in a planar shape. Therefore, this improves thermal conductivity between the metal shell and the fusion portion, thus reducing a temperature rise of the fusion portion. Accordingly, this reduces the progression of oxidation in the fusion portion, thus improving the welding strength between the ground electrode and the metal shell.

Application Example 5

In the spark plug described in application example 4, in the cross section, the shape of the ground-electrode-side melted boundary is a convex shape to the metal shell side.

The spark plug of the application example 5 enlarges a volume of the base material of the ground electrode with a high thermal conductivity. This reduces a temperature of the distal end portion of the ground electrode, thus inhibiting the formation of an oxide film on the distal end portion of the ground electrode.

Application Example 6

In the spark plug described in application example 5, a noble metal tip is joined to a distal end portion of the ground electrode.

The spark plug of the application example 6 enlarges the volume of the base material of the ground electrode with a high thermal conductivity. This reduces a temperature of the distal end portion of the ground electrode, thus reducing a drop in bonding durability of the noble metal tip.

Application Example 7

In the spark plug described in application example 4, the shape of the metal-shell-side melted boundary in the cross section includes at least two or more portions among at least one of a convex portion that is convex to the metal shell side and a concave portion that is concave to the ground electrode side, The spark plug of the application example 7 may be configured as follows. The shape of the metal-shell-side melted boundary includes at least two or more portions among at least one of a convex portion that is convex to the metal shell side and a concave portion that is concave to the ground electrode side. This further increases the contact area between the metal shell and the fusion portion. Accordingly, this further reduces a temperature rise of the fusion portion and further improves bonding strength between the metal shell and the ground electrode.

Application Example 8

In the spark plug described in any one of application examples 1 to 7, the ground electrode is formed of noble metal or alloy containing noble metal.

The spark plug described in the application example 8 may adopt a ground electrode formed of noble metal or alloy containing noble metal. This enlarges the degree of freedom in selection of a type of the spark plug.

Application Example 9

A method for manufacturing the spark plug described any one of application examples 1 to 8 includes: a step for preparing a metal shell workpiece that becomes a metal shell after welding and preparing a ground electrode workpiece that becomes a ground electrode after welding; and a step for welding the metal shell workpiece and the ground electrode workpiece. A material of the ground electrode workpiece has a higher melting point than a melting point of a material of the metal shell workpiece. In a case where: in the cross section, a thickness of the ground electrode workpiece is assumed to be F; and a thickness of an end face of the metal shell workpiece at a side welded to the ground electrode workpiece is assumed to be G, a condition of F>G is satisfied.

In the spark plug manufactured by this manufacturing method, the fusion portion is configured such that the material of the ground electrode workpiece with a relatively high melting point is formed in a large proportion compared with the material of the metal shell workpiece with a relatively low melting point. Accordingly, this improves bonding durability between the ground electrode and the metal shell in the spark plug in use, that is, at a high temperature.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 6 is a table illustrating a result of a first welding strength evaluation test.

FIG. 7 is a table illustrating a result of a second welding strength evaluation test.

FIG. 8 is a table illustrating a result of a third welding strength evaluation test.

FIG. 9 is a table illustrating a result of a fourth welding strength evaluation test.

FIG. 11 is a table illustrating a welding strength evaluation test result of a fusion portion 170.

FIG. 13 is a table illustrating a welding strength evaluation test result of a fusion portion 175.

FIG. 16 is an explanatory diagram illustrating a result of the oxide film formation evaluation test in a distal end portion of the ground electrode 530.

FIG. 19 is an explanatory diagram illustrating a result of the bonding durability evaluation test on the noble metal tip 60.

DETAILED DESCRIPTION OF THE INVENTION

Mode for Carrying Out the Invention

A. Embodiment

A1. Schematic Configuration of a Spark Plug 100

Figure 1:
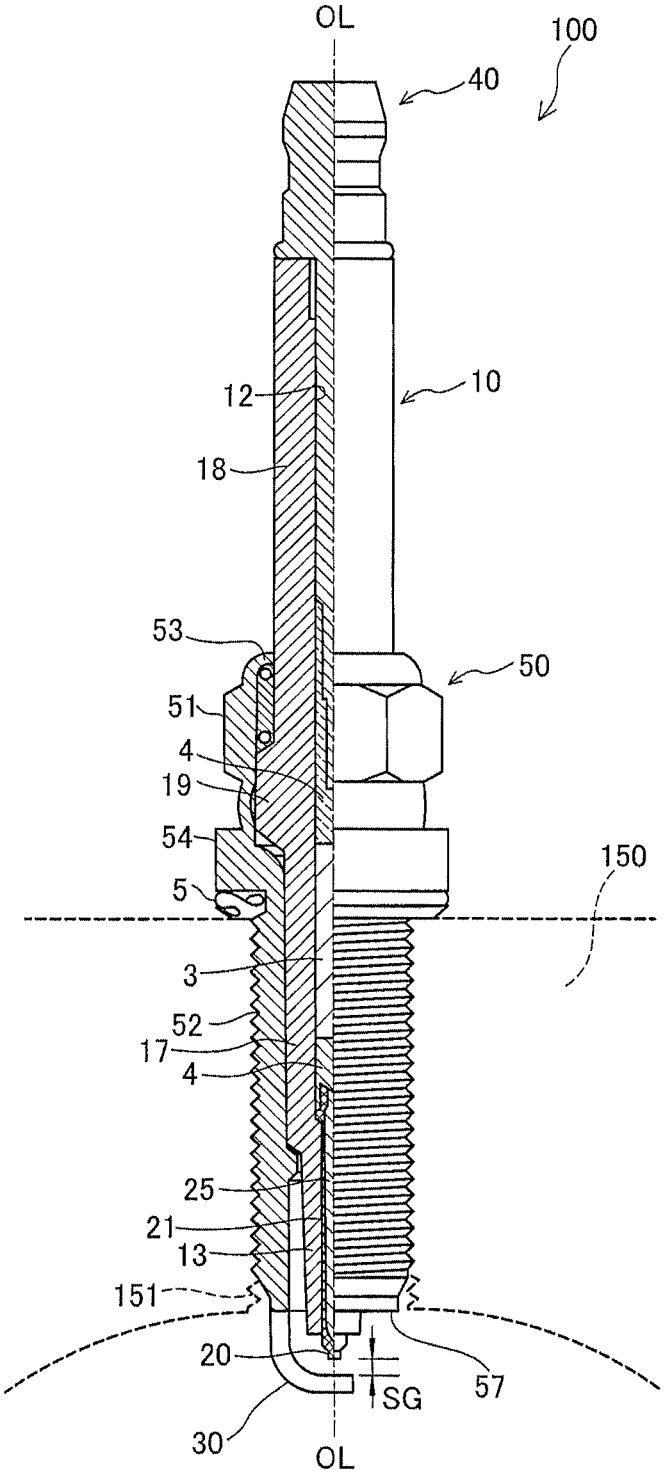
FIG. 1 is a partial sectional diagram illustrating a schematic configuration of a spark plug 100.

FIG. 1 is a partial sectional view of a spark plug 100 as an embodiment of a spark plug according to the present invention. In FIG. 1, a right side of an axis OL, which is illustrated by a one-dot chain line, illustrates an exterior front view while a left side of the axis OL illustrates a sectional view of the spark plug 100 taken along a cross section passing through the central axis of the spark plug 100. Hereinafter, in FIG. 1, descriptions will be given of a lower side of the spark plug 100 in the axis OL direction as a tip end side of the spark plug 100 and the upper side as a rear end side. The spark plug 100 includes an insulator 10, a center electrode 20, a ground electrode 30, a terminal electrode 40, and a metal shell 50.

The insulator 10 is a cylindrical insulator where a shaft hole 12 is formed at the center. The shaft hole 12 houses the center electrode 20 and the terminal electrode 40. The shaft hole 12 is formed to extend in the direction of the axis OL. The insulator 10 is formed by sintering ceramic material including alumina. At the center in the direction of the axis OL of the insulator 10, a center trunk portion 19 is formed to have the largest outside diameter in the insulator 10. At the rear end side with respect to the center trunk portion 19 of the insulator 10, a rear-end-side trunk portion 18 is formed to insulate between the terminal electrode 40 and the metal shell 50. At the tip end side with respect to the center trunk portion 19 of the insulator 10, a tip-end-side trunk portion 17 is formed to have a smaller outside diameter than that of the rear-end-side trunk portion 18. Further at the tip end side of the tip-end-side trunk portion 17 of the insulator 10, an insulator nose length portion 13 is formed to have a smaller outer diameter than that of the tip-end-side trunk portion 17. The outer diameter of the insulator nose length portion 13 is reduced toward the center electrode 20 side.

The center electrode 20 is inserted into the shaft hole 12 of the insulator 10. The center electrode 20 is a rod-shaped member where a core material 25 is buried inside of an electrode base metal 21 formed in a cylindrical shape with a closed bottom. The core material 25 has higher thermal conductivity than that of the electrode base metal 21. In this embodiment, the electrode base metal 21 is formed of nickel alloy that includes nickel (Ni) as a main constituent. The core material 25 is formed of copper or alloy that includes copper as a main constituent. The center electrode 20 is held at the insulator 10 inside of the shaft hole 12. At the tip end side of the center electrode 20, a tip end of the center electrode 20 is exposed outside from the shaft hole 12 (the insulator 10). This center electrode 20 is electrically coupled to the terminal electrode 40 via a ceramic resistor 3 and a seal body 4 that are inserted into the shaft hole 12.

The ground electrode 30 is constituted of a metal with high corrosion resistance. As an example, nickel alloy is used. The ground electrode 30 includes a base end that is welded to a distal end face 57 of the metal shell 50. The ground electrode 30 and the terminal electrode 40, in this embodiment, are welded together by laser beam welding. The distal end portion of the ground electrode 30 is bent toward the axis OL. Between this distal end portion of the ground electrode 30 and the distal end face of the center electrode 20, a spark gap SG is formed to generate spark discharge.

The terminal electrode 40 is disposed at the rear end side of the shaft hole 12, and a part of the terminal electrode 40 at the end side is exposed from a rear end side of the insulator 10. The terminal electrode 40 is coupled to a high-voltage cable (not shown) via a plug cap (not shown), and a high voltage is applied.

The metal shell 50 is a cylindrically-shaped metal shell that surrounds a portion from a part of the rear-end-side trunk portion 18 of the insulator 10 across the insulator nose length portion 13 in a circumferential direction to hold the portion. The metal shell 50 is formed of low-carbon steel, and a plating process such as nickel plating and galvanizing is performed on the entire metal shell 50. The metal shell 50 includes a tool engagement portion 51, a mounting screw portion 52, a crimp portion 53, and a seal portion 54. These are formed from the rear end toward the tip end in the order corresponding to the crimp portion 53, the tool engagement portion 51, the seal portion 54, and the mounting screw portion 52. The tool engagement portion 51 fits a tool for installation of the spark plug 100 on an engine head 150 of the internal combustion engine. The mounting screw portion 52 has a thread screwed into a mounting screw hole 151 of the engine head 150.

The crimp portion 53 is a thin-walled member disposed at an end portion of the metal shell 50 at the rear end side, and used such that the metal shell 50 holds the insulator 10. Specifically, when the spark plug 100 is manufactured, the crimp portion 53 is folded inward and this crimp portion 53 is pressed to the tip end side. Accordingly, in a state where the tip end of the center electrode 20 is projected from the tip end side of the metal shell 50, the insulator 10 is integrally held in the metal shell 50. The seal portion 54 is formed in a flange shape at the base of the mounting screw portion 52. Between the seal portion 54 and the engine head, an annular gasket 5 formed by folding a sheet is fitted by insertion. The spark plug 100 is installed on the mounting screw hole 151 via the metal shell 50.

Figure 2:
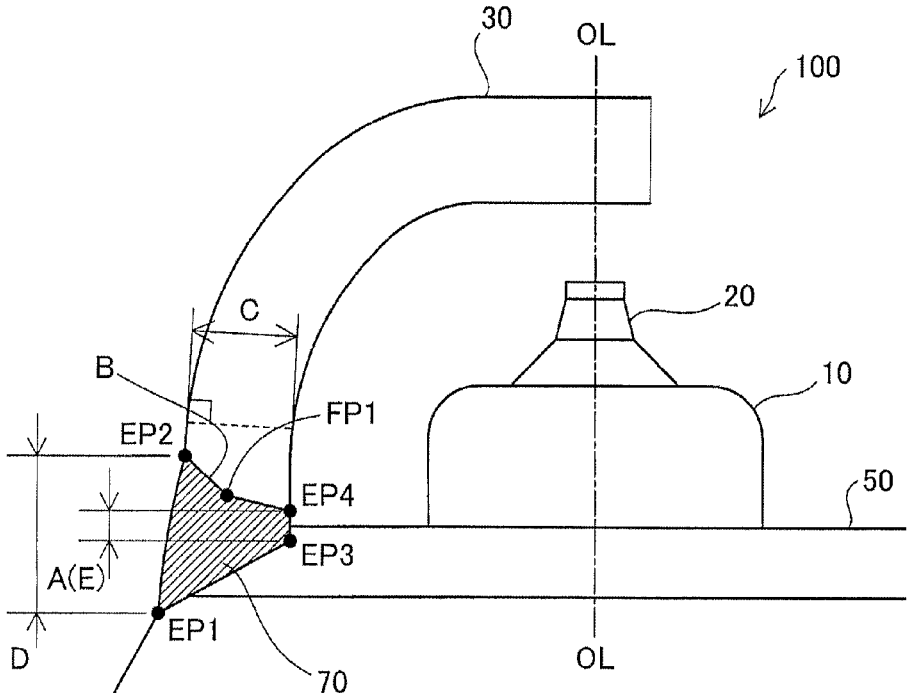
FIG. 2 is an expansion figure of a welded portion between a ground electrode 30 and a metal shell 50.

FIG. 2 is an expansion figure of a welded portion between the ground electrode 30 and the metal shell 50. As illustrated in the drawing, the ground electrode 30 and the metal shell 50 are joined via a fusion portion 70. The fusion portion 70 is a portion formed by melting both the ground electrode 30 and the metal shell 50 using laser beam welding. As illustrated in FIG. 2, an entire end face of the base end of the ground electrode 30 is melted. FIG. 2 illustrates appearances of the ground electrode 30 and the metal shell 50 while illustrating a shape of a cross section of the fusion portion 70. The cross section includes the center line of the ground electrode 30, and is parallel to the axis OL (hereinafter also referred to simply as a cross section).

Regarding the cross section of the fusion portion 70, at the boundary between the fusion portion 70 and the metal shell 50, an end point on the opposite side (an outer side of the spark plug 100) of the center electrode 20 is also referred to as a first end point EP1. Similarly, at the boundary between the fusion portion 70 and the ground electrode 30, an end point on the opposite side of the center electrode 20 is also referred to as a second end point EP2. At the boundary between the fusion portion 70 and the metal shell 50, an end point at a side (an inner side of the spark plug 100) of the center electrode 20 is also referred to as a third end point EP3. At the boundary between the fusion portion 70 and the ground electrode 30, an end point at the side of the center electrode 20 is also referred to as a fourth end point EP4.

In this embodiment, the boundary between the fusion portion 70 and the metal shell 50 is formed in a linear shape. That is, the boundary between the fusion portion 70 and the metal shell 50 coincides with a line that linearly connects the first end point EP1 and the third end point EP3. Additionally, in this embodiment, the boundary between the fusion portion 70 and the ground electrode 30 is formed by two linear shapes. That is, the boundary between the fusion portion 70 and the ground electrode 30 coincides with a line that linearly connects the second end point EP2 and a folding point FP1 and a line that linearly connects the folding point FP1 and the fourth end point EP4. While in this embodiment the folding point FP1 is positioned at the rear end side of the line linearly connecting the second end point EP2 and the fourth end point EP4, the folding point FP1 may be positioned at the tip end side.

In the cross section of the fusion portion 70, regarding a thickness in the axis OL direction, a thickness of a portion with the smallest thickness is also referred to as a thickness A (mm). In this embodiment, as illustrated in FIG. 2, a thickness of the fusion portion 70 in the axis OL direction gradually decreases from the outside of the spark plug 100 toward the inside. Accordingly, the thickness A is specified as a distance between the third end point EP3 and the fourth end point EP4 in the axis OL direction.

Accordingly, in the cross section of the fusion portion 70, a length of the boundary between the fusion portion 70 and the ground electrode 30, that is, a summed value of: a length of the line linearly connecting the second end point EP2 and the folding point FP1; and a length of the line linearly connecting the folding point FP1 and the fourth end point EP4 is also referred to as a length B (mm).

In the cross section of the ground electrode 30, a thickness of the ground electrode 30 is also referred to as a thickness C (mm). In this embodiment, the thickness C is evenly formed irrespective of a position along the axis OL. The thickness C is a thickness in a direction perpendicular to the axis OL in a portion where the ground electrode 30 is not bent. A representative thickness C may be measured in a position (hereinafter referred to as a specific position) located 1 mm from the second end point EP2 toward the tip end side along the axis OL direction. In this case, a specific point is a point on an outline outside of the ground electrode 30 in the specific position. At the specific point, a thickness of the ground electrode 30 in a direction perpendicular to a tangent to the outline is the thickness C.

In the cross section of the fusion portion 70, a length in the axis OL direction between the first end point EP1 and the second end point EP2 is also referred to as a length D (mm). Similarly, a length in the axis OL direction between the third end point EP3 and the fourth end point EP4 is also referred to as a length E (mm). The length E corresponds to the above-described length A in this embodiment.

The above-described spark plug 100 satisfies conditions of expression (1) and expression (2) below. Additionally, the spark plug 100 satisfies a condition of expression (3) below. The condition of expression (3) is a selective condition. The meaning of satisfying this condition will be described below.

$$A \geq 0.2 \text{ mm} \quad (1)$$

$$B > C \quad (2)$$

$$D > E \quad (3)$$

Figure 3:
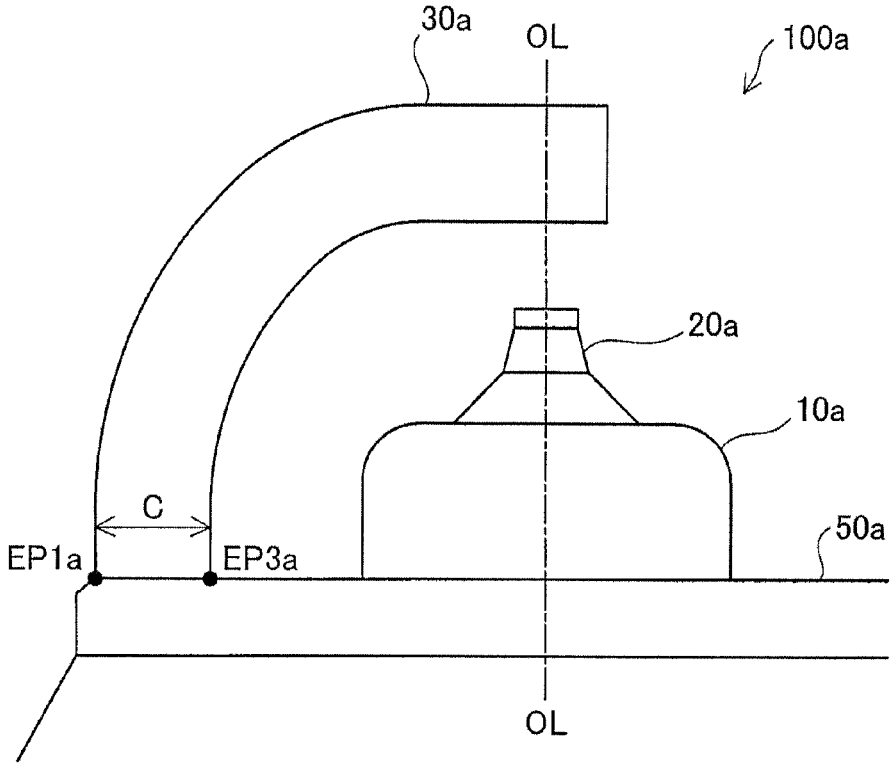
FIG. 3 is an expansion figure of a welded portion between a ground electrode 30*a* and a metal shell 50*a* in a spark plug 100*a* as a comparative example.

FIG. 3 is an expansion figure of a welded portion between a ground electrode 30*a* and a metal shell 50*a* of a spark plug 100*a* as a comparative example. In the spark plug 100*a*, the ground electrode 30*a* and the metal shell 50*a* are joined together by resistance welding. In the case where the resistance welding is adopted, the portion equivalent to the fusion portion 70 of the spark plug 100 is not formed. That is, as illustrated in FIG. 3, a straight line that connects the first end point EP1*a* and the third end point EP3*a* is formed at the boundary between the ground electrode 30*a* and the metal shell 50*a*. A difference in performance between this spark plug 100*a* and the spark plug 100 of this embodiment will be described below.

A2. Method for Manufacturing the Spark Plug 100

Figure 4:
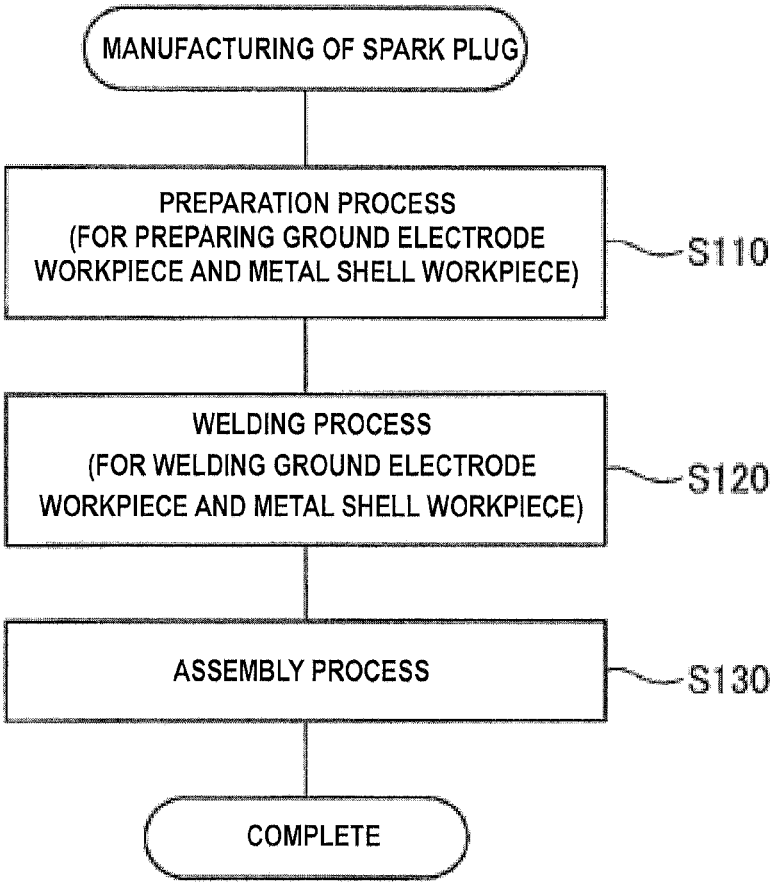
FIG. 4 is a process drawing illustrating a manufacturing procedure of the spark plug 100.

FIG. 4 is a process drawing illustrating a manufacturing procedure of the spark plug 100. A manufacturing process of the spark plug 100 is classified into a preparation process (step S110), a welding process (step S120), and an assembly process (step S130). In the preparation process (step S110), first, respective components of the spark plug 100 are manufactured. Subsequently, the center electrode 20, the ceramic resistor 3, the seal body 4, and the terminal electrode 40 are inserted into the manufactured insulator 10 in a predetermined order, and these are integrally formed by a heat compression process referred to as glass seal. Additionally, a workpiece (hereinafter also referred to as a ground electrode workpiece W30) of the ground electrode 30 and a workpiece (hereinafter also referred to as a metal shell workpiece W50) of the metal shell 50 are prepared. The ground electrode workpiece W30 becomes the ground electrode 30 after welding, and is a rod-shaped member without a bend. The metal shell workpiece W50 becomes the metal shell 50 after welding. On the metal shell workpiece W50, in order to have a required shape, a predetermined work such as plastic work and cutting is performed to form the tool engagement portion 51, the seal portion 54, and similar member.

Figure 5:
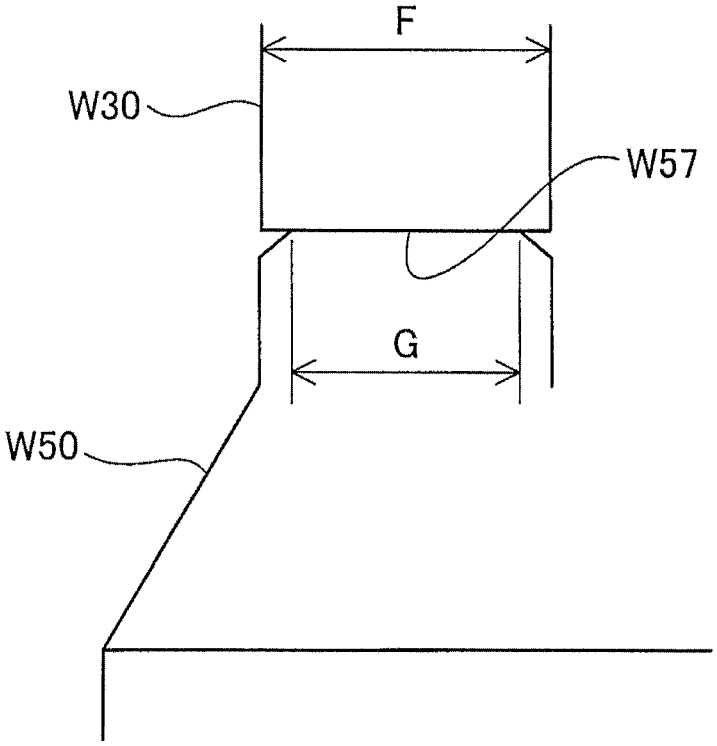
FIG. 5 is an explanatory diagram illustrating a relationship in size between a ground electrode workpiece W30 and a metal shell workpiece W50.

FIG. 5 illustrates a relationship in size between the ground electrode workpiece W30 and the metal shell workpiece W50. FIG. 5 illustrates a cross section corresponding to FIG. 2. As illustrated in the drawing, a thickness of the ground electrode workpiece W30 is also referred to as a thickness F (mm). Additionally, regarding the metal shell workpiece W50, an end face at a side to be welded to the ground electrode workpiece W30, that is, a thickness of a distal end face W57 is also referred to as a thickness G (mm). The thickness F and the thickness G are thicknesses in a direction perpendicular to the axis OL. The thickness F and the thickness G satisfy a condition of expression (4) below. As a material of the ground electrode workpiece W30, a material with a higher melting point than that of a material of the metal shell workpiece W50 is adopted. The condition of the expression (4) and the material conditions of the ground electrode workpiece W30 and the metal shell workpiece W50 are selective conditions. The meaning of satisfying these conditions will be described below.

$$F > G \quad (4)$$

In the welding process (step S120), the ground electrode workpiece W30 is joined to the distal end face W57 of the metal shell workpiece W50 before the insulator 10 is assembled by laser beam welding. Specifically, after the ground electrode workpiece W30 and the metal shell workpiece W50 are arranged in a positional relationship for joining, a laser irradiates from the outside of the ground electrode workpiece W30, that is, a side of the first end point EP1 and the second end point EP2. The laser may irradiate while its irradiation speed is changed such that the fusion portion 70 in the shape illustrated in FIG. 2 is formed. Similarly, the laser may irradiate obliquely, that is, at an intersection angle smaller than 90° with respect to the axis OL. Additionally, the laser may irradiate while its irradiation position is changed.

In the assembly process (step S130), first, the tip end side of the welded ground electrode 30 is cut such that the ground electrode 30 has a required length. Subsequently, a thread is formed in the mounting screw portion 52, and a plating process is performed on the metal shell 50. Subsequently, the insulator 10 integrated with the center electrode 20 by a glass seal is inserted into the metal shell 50. Subsequently, the crimp portion 53 of the metal shell 50 is crimped by folding inward. In a state where the tip end of the center electrode 20 is projected from the tip end side of the metal shell 50, the insulator 10 is integrally held in the metal shell 50. Subsequently, bending work where the rod-shaped ground electrode 30 is bent toward the center electrode 20 side is performed. Subsequently, the gasket 5 is inserted into the metal shell 50 from the tip end side. While an inner diameter side of the gasket 5 is compressed in the axis OL direction, the gasket 5 is installed on the metal shell 50. Thus, the spark plug 100 is completed.

FIG. 6 illustrates a result of a first welding strength evaluation test. In the first welding strength evaluation test, samples 1 to 8 of the spark plug were prepared. In samples 1 to 8, the method for welding the ground electrode and the metal shell, the thickness A of the fusion portion, the length B of the fusion portion, and the thickness C of the ground electrode were varied. Regarding respective samples 1 to 8, a welding strength between the ground electrode and the metal shell was evaluated. The thickness A and the length B of the fusion portion 70 were measured such that a cross section of the welding portion between the ground electrode and the metal shell was taken along a surface including the central axis of the ground electrode, an etching process was performed on this surface, and then an image of the surface was taken using a microscope with 50 magnification. The method for evaluating the welding strength is as follows.

(1) Samples of the spark plug are prepared.

(2) After the ground electrode is folded at 90° inward (the center electrode side), the state is restored. This folding operation is repeated more than once.

(3) In case of a fracture generated in the joined portion between the ground electrode and the metal shell when the folding operation is repeated twice or less, the result is evaluated as "normal". In case of a fracture generated when the folding operation is repeated three or four times, the result is evaluated as "good". In the case where a fracture is not generated when the folding operation is repeated four times, the result is evaluated as "excellent".

Samples 1 and 2 where the ground electrode and the metal shell welded by resistance welding each have the configuration of the spark plug 100*a* of the comparative example illustrated in FIG. 3. Samples 3 to 8 (hereinafter also referred to as laser beam welding samples) where the ground electrode and the metal shell are welded by laser beam welding each have a configuration of a spark plug 200 of a modification illustrated in FIG. 14(A) below. That is, the laser beam welding sample, in the spark plug 100 as an embodiment illustrated in FIG. 2, is a spark plug without the folding point FP1, in other words, a spark plug where the boundary between the ground electrode 30 and the fusion portion 70 are positioned on the line linearly connecting the second end point EP2 and the fourth end point EP4.

As illustrated in FIG. 6, both cases adopting resistance welding were evaluated as "normal". In case of adopting laser beam welding, the evaluations were divided depending on the values of the thickness A and the length B. Specifically, in the case where the above-described expression (1), that is, the condition of A≥0.2 mm and the above-described expression (2), that is, the condition of B>C are simultaneously satisfied, evaluation of "good" is obtained. Specifically, regarding sample 6 where the thickness A is 0.2 mm and the length B is 1.1 times longer than the thickness C, sample 7 where the thickness A is 0.2 mm and the length B is 1.3 times longer than the thickness C, and sample 8 where the thickness A is 0.2 mm and the length B is 1.7 times longer than the thickness C, evaluation of "good" was obtained.

As described above, regarding the spark plug 100 of this embodiment, in the case where the thickness A of the fusion portion 70 equal to or more than a predetermined thickness is maintained and the length B of the fusion portion 70 is longer than the length B by resistance welding, that is, the length B is longer than the thickness C of the ground electrode 30, the bonding strength improves. The case where the length B of the fusion portion 70 is longer than the length B by resistance welding is a case where the boundary line between the fusion portion 70 and the ground electrode 30 has a shape other than a linear shape perpendicular to the axis OL. In this case, lengthening the length B of the fusion portion 70 enhances the bonding strength between the ground electrode 30 and the metal shell 50.

FIG. 7 illustrates a result of a second welding strength evaluation test. In the second welding strength evaluation test, samples of the spark plug 100 (or 200) were prepared. In the samples, the length B of the fusion portion 70 and existence of the folding point FP1 are varied. Regarding the respective samples, a welding strength between the ground electrode 30 and the metal shell 50 was evaluated. Laser beam welding is a welding method of the samples. The thickness A of the fusion portion 70 is 0.2 mm. The thickness C of the ground electrode 30 is 1.5 mm. Samples 6 and 8 illustrated in FIG. 7 are the same as samples 6 and 8 illustrated in FIG. 6 without the folding point FP1. Conversely, samples 9 and 10 illustrated in FIG. 7 each have the folding point FP1, and each have a configuration of the spark plug 100 of the embodiment illustrated in FIG. 2. An evaluation method is the same as that of the first welding strength evaluation test.

As illustrated in FIG. 7, regarding samples 9 and 10 with the folding point FP1, evaluation of "excellent" was obtained. That is, it was confirmed that the shape at the boundary between the ground electrode 30 and the fusion portion 70 with the folding point FP1 enhanced the welding strength between the ground electrode 30 and the metal shell 50. This means that bonding durability between the ground electrode 30 and the metal shell 50 of the spark plug 100 in use improves. This is because, since the folding point FP1 is formed at the boundary between the ground electrode 30 and the fusion portion 70, this configuration can disperse a direction of a stress acting at the boundary between the fusion portion 70 and the ground electrode 30 along with a vibration generated by the spark plug 100 in use. The shape of the boundary between the ground electrode 30 and the fusion portion 70 providing this efficiency is not limited to a shape formed of the two straight lines (the straight line connecting the second end point EP2 and the folding point FP1, and the straight line connecting the folding point FP1 and the fourth end point EP4). For example, the shape at the boundary between the ground electrode 30 and the fusion portion 70 may be a curved line, or may be a shape formed of a plurality of straight lines. Alternatively, a shape formed of a combination of one or more curved lines and one or more straight lines may be possible. In these cases, the curved line may not include a folding point or may include a folding point.

FIG. 8 illustrates a result of a third welding strength evaluation test. In the third welding strength evaluation test, samples of the spark plug 100 were prepared. In the samples, the length B and a magnitude relationship between the lengths D and E were varied in the fusion portion 70. Regarding the respective samples, a welding strength between the ground electrode 30 and the metal shell 50 was evaluated. Laser beam welding is a welding method of the samples. The thickness A of the fusion portion 70 is 0.2 mm. The thickness C of the ground electrode 30 is 1.5 mm. Samples 9 and 10 illustrated in FIG. 8 are the same as samples 9 and 10 illustrated in FIG. 7, and each have the configuration of the spark plug 100 of the embodiment illustrated in FIG. 2. Conversely, samples 11 and 12 illustrated in FIG. 8 do not satisfy the condition of the above-described expression (3). That is, samples 11 and 12 each have the configuration of a spark plug 700 as a modification illustrated in FIG. 14(F) below. In the third welding strength evaluation test, a more stringent test condition is set compared with the first welding strength evaluation test. Specifically, considering the condition of the spark plug 100 used in the internal combustion engine, after the ground electrode 30 was heated, the welding strength was evaluated by the same evaluation method as that of the above-described first welding strength evaluation test. Heating of the ground electrode 30, using a burner, is performed to heat an outer side (the opposite side of the center electrode 20) of the ground electrode 30 to approximately 300° C. The outer side is heated because, while the spark plug 100 is used, the outer side is exposed to a high temperature compared with an inner side (a side of the center electrode 20).

As illustrated in FIG. 8, in samples 9 and 10 that satisfy the condition of the above-described expression (3), evaluation of "excellent" was obtained. Conversely, in samples 11 and 12 that do not satisfy the condition of the expression (3), evaluation of "good" was obtained. That is, it was confirmed that satisfying the condition of the expression (3) under a condition suitable for a use condition of the spark plug 100 improved bonding durability between the ground electrode 30 and the metal shell 50. This efficiency is obtained due to a large length of the fusion portion 70 in the axis OL direction at the outer side of the ground electrode 30 exposed to a high temperature condition compared with the inner side of the ground electrode 30 of the spark plug 100 in use.

FIG. 9 illustrates a result of a fourth welding strength evaluation test. In the fourth welding strength evaluation test, samples of the spark plug 100 were prepared. In the samples, the spark plug 100 was manufactured such that a magnitude relationship between the thickness F of the ground electrode workpiece W30 and the thickness G of the metal shell workpiece W50 was varied. Regarding the respective samples, a welding strength between the ground electrode 30 and the metal shell 50 was evaluated. Laser beam welding is a welding method of the samples. The thickness A of the fusion portion 70 is 0.2 mm. The length B of the fusion portion 70 is 2.5 mm. The thickness C of the ground electrode 30 is 1.5 mm. A material of the ground electrode workpiece W30 is nickel alloy while a material of the metal shell workpiece W50 is low-carbon steel. That is, the material of the ground electrode workpiece W30 has a higher melting point than that of the material of the metal shell workpiece W50. In the fourth welding strength evaluation test, a more stringent test condition was set compared with the third welding strength evaluation test. Specifically, after a heating temperature of the ground electrode 30 was increased to approximately 500° C., the welding strength was evaluated by the same evaluation method as that of the above-described first welding strength evaluation test.

As illustrated in FIG. 9, in sample 13 that satisfies the above-described expression (4), evaluation of "good" was obtained. Conversely, in sample 14 that does not satisfy the condition of the expression (4), evaluation of "normal" was obtained. That is, it was confirmed that satisfying the condition of the expression (4) under a condition suitable for a use condition of the spark plug 100 improved bonding durability between the ground electrode 30 and the metal shell 50. This efficiency is obtained due to the configuration of the fusion portion 70 where the material of the ground electrode workpiece W30 with a relatively high melting point has a large proportion compared with the material of the metal shell workpiece W50 with a relatively low melting point.

B. Second Embodiment

While in the first embodiment the shape of the interfacial boundary at the ground electrode side of the fusion portion 70 is described, in the second embodiment a shape of an interfacial boundary at the metal shell side of the fusion portion will be described.

B1. Detailed Configuration of the Fusion Portion

Figure 10:
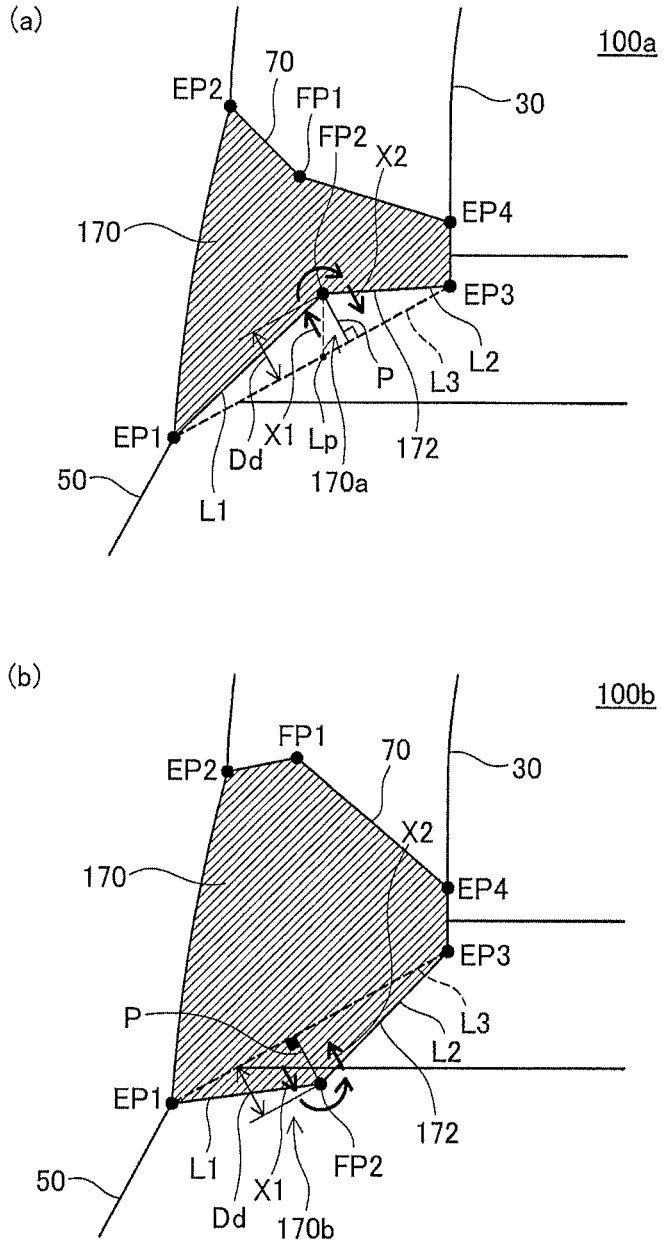
FIG. 10 is an expansion figure of a welded portion between the ground electrode 30 and the metal shell 50 in a second embodiment.

FIG. 10 is an expansion figure of a welded portion between the ground electrode 30 and the metal shell 50 in the second embodiment. FIG. 10(*a*) illustrates an interfacial boundary formed in a concave shape at the ground electrode 30 side. FIG. 10(*b*) illustrates an interfacial boundary formed in a convex shape at the metal shell 50 side. First, by referring to FIG. 10(*a*), a metal-shell-side melted boundary 172 of the fusion portion 170 will be described. Similarly to the first embodiment, the ground electrode 30 and the metal shell 50 are joined together via the fusion portion 170. The fusion portion 170 is a portion formed by melting both the ground electrode 30 and the metal shell 50 using laser beam welding. FIG. 10 illustrates a cross section that includes the center line of the ground electrode 30 and the axis OL, and is parallel to the axis OL. In the fusion portion 170 of the second embodiment, like reference numerals designate corresponding or identical points throughout the first embodiment and the second embodiment. Specifically, these points are the first end point EP1, the second end point EP2, the third end point EP3, the fourth end point EP4, and the folding point FP1.

In the second embodiment, the metal-shell-side melted boundary 172 is formed of two linear shapes. That is, the metal-shell-side melted boundary 172 coincides with: a line L1 that linearly connects the first end point EP1 and a folding point FP2, and a line L2 that linearly connects the folding point FP2 and the third end point EP3. In other words, the fusion portion 170 includes a concave portion 170*a* formed in a concave shape at the ground electrode 30 side by the line L1 and the line L2. A line L3 is a straight line where a distance between the first end point EP1 and the third end point EP3 is shortest.

The folding point of the metal-shell-side melted boundary 172 is a point where a moving direction of a trajectory of the metal-shell-side melted boundary 172 changes. Specifically, the trajectory of the metal-shell-side melted boundary 172 includes: a first straight line representing a trajectory that moves from one end of the metal-shell-side melted boundary 172 as a starting point in a direction separating from the line L3, and a second straight line representing a trajectory that moves in a direction approaching the line L3. The folding point is an intersection point with a length equal to or more than a predetermined length (equal to or more than 0.01 mm in the second embodiment) of the vertical line from an intersection point between the first straight line and the second straight line to the line L3. That is, in the second embodiment, regarding the folding point FP2, a trajectory of the metal-shell-side melted boundary 172 includes: the line L1 extending from the first end point EP1 of the metal-shell-side melted boundary 172 as the starting point in the direction (an arrow head X1) separating from the line L3, and the line L2 that moves from a different end point from the first end point EP1 on the line L1 in the direction (an arrow head X2) approaching the line L3. In the case where a length Dd of a vertical line P from the intersection point between the line L1 and the line L2 to the line L3 is equal to or more than a predetermined length, this intersection point is the folding point FP2.

Next, by referring to FIG. 10(*b*), a description will be given of an embodiment where the boundary of the fusion portion is formed in a convex shape at the metal shell 50 side. The metal-shell-side melted boundary 172 is formed of two linear shapes. That is, the metal-shell-side melted boundary 172 coincides with: the line L1 that linearly connects the first end point EP1 and the folding point FP2, and the line L2 that linearly connects the folding point FP2 and the third end point EP3. In other words, the fusion portion 170 includes a convex portion 170*b* that is formed in a convex shape at the metal shell 50 side and formed of the line L1 and the line L2.

Regarding the folding point FP2, the trajectory of the metal-shell-side melted boundary 172 includes: the line L1 that extends from the first end point EP1 of the metal-shell-side melted boundary 172 as the starting point in the direction (the arrow head X1) separating from the line L3, and the line L2 that moves from a different end point from the first end point EP1 on the line L1 in the direction (the arrow head X2) approaching the line L3. In the case where the length Dd of the vertical line P from the intersection point between the line L1 and the line L2 to the line L3 is equal to or more than a predetermined length, this intersection point is the folding point FP2.

In this description, formation of the boundary of the fusion portion in a concave shape at the ground electrode 30 side means that the folding point is positioned at the ground electrode 30 side with respect to a straight line connecting respective end points that are different from the folding point on two straight lines sandwiching the folding point. Formation of the boundary of the fusion portion in a convex shape at the metal shell 50 side means that the folding point is positioned at the metal shell 50 side with respect to a straight line connecting respective end points that are different from the folding point on two straight lines sandwiching the folding point. For example, in FIG. 10(*a*), the boundary of the fusion portion is positioned at the ground electrode 30 side with respect to the straight line L3 connecting the respective end points (the first end point EP1 and the third end point EP3) different from the folding point FP2 on the two straight lines (the lines L1 and L2) sandwiching the folding point FP2. The boundary of the fusion portion 170 illustrated in FIG. 10(*a*) is formed in a concave shape at the ground electrode 30 side. In FIG. 10(*b*), the boundary of the fusion portion is positioned at the metal shell 50 side with respect to the straight line L3 connecting the respective end points (the first end point EP1 and the third end point EP3) different from the folding point FP2 on the two straight lines (the lines L1 and L2) sandwiching the folding point FP2. The boundary of the fusion portion 170 illustrated in FIG. 10(*b*) is formed in a convex shape at the metal shell 50 side.

B2. Evaluation Result

FIG. 11 illustrates a result of a welding strength evaluation test of the fusion portion 170. In the welding strength evaluation test, samples of the spark plug 100*a* are prepared. In the samples, a length H of the metal-shell-side melted boundary 172 of the fusion portion 170 and existence of the folding point FP2 are varied. Regarding the respective samples, a welding strength between the ground electrode 30 and the metal shell 50 was evaluated. Laser beam welding is a welding method of the samples. The thickness A of the fusion portion 170 is 0.2 mm. The thickness C of the ground electrode 30 is 1.5 mm. Samples 15 and 17 do not have the folding point FP2. Samples 16 and 18 each have the folding point FP2, and each have a configuration of the spark plug 100*a* of the embodiment illustrated in FIG. 10(*a*). The evaluation method of the welding strength is as follows.

(1) Samples of the spark plug are prepared.

(2) A distal end portion (an igniting portion) of the ground electrode 30 is heated for one minute such that an electrical surface (a distal end face) of the metal shell reaches 300° C., and is subsequently cooled for one minute. This heating-cooling cycle is repeated 500 cycles.

(3) After the ground electrode is folded at 90° inward (the center electrode side), the state is restored. This folding operation is repeated more than once.

(4) In case of a fracture generated in the joined portion between the ground electrode and the metal shell by the folding operation repeated twice or less, the result is evaluated as "normal". In case of a fracture generated by the folding operation repeated three or four times, the result is evaluated as "good". In case of no fracture generated by the folding operation repeated four times, the result is evaluated as "excellent".

As illustrated in FIG. 11, in samples 16 and 18 that each have the folding point FP2, evaluation of "excellent" was obtained. That is, it was confirmed that the boundary between the metal shell 50 and the fusion portion 170 in a shape with the folding point FP2 improved a welding strength between the ground electrode 30 and the metal shell 50. This is because, since the folding point FP2 is formed at the boundary between the metal shell 50 and the fusion portion 170, this configuration can disperse a direction of a stress acting at the boundary between the fusion portion 170 and the metal shell 50 along with a vibration generated by the spark plug 100 in use.

With the spark plug in the above-described second embodiment, the shape of the metal-shell-side melted boundary 172 as the boundary between the fusion portion 170 and the metal shell 50 is formed of a plurality of straight lines. Accordingly, compared with a case where the metal shell 50 and the fusion portion 170 are formed in a planar shape, this enlarges the area of the metal-shell-side melted boundary 172, that is, a contact area between the fusion portion 170 and the metal shell 50. Therefore, this improves thermal conductivity between the metal shell 50 and the fusion portion 170, thus reducing a temperature rise of the fusion portion 170. Accordingly, this reduces the progression of oxidation in the fusion portion 170, thus improving the bonding strength between the ground electrode 30 and the metal shell 50.

C. Third Embodiment

C1. Detailed Configuration of the Fusion Portion

The shape of the metal-shell-side melted boundary 172, described in the second embodiment, provides the efficiency that disperses the direction of the stress acting the boundary between the fusion portion 170 and the metal shell 50. This shape is not limited to the shape formed of the two straight lines (the line L1 and the line L2). For example, the shape of the boundary between the metal shell 50 and the fusion portion 170 may be a curved line, or may be a shape formed of a plurality of straight lines. Alternatively, the shape may be a shape formed of a combination of one or more curved lines and one or more straight lines. In these cases, the curved line may not include folding point or may include a folding point. In the third embodiment, a description will be given of an embodiment where the metal-shell-side melted boundary of the fusion portion between the ground electrode and the metal shell includes a plurality of folding points.

Figure 12:
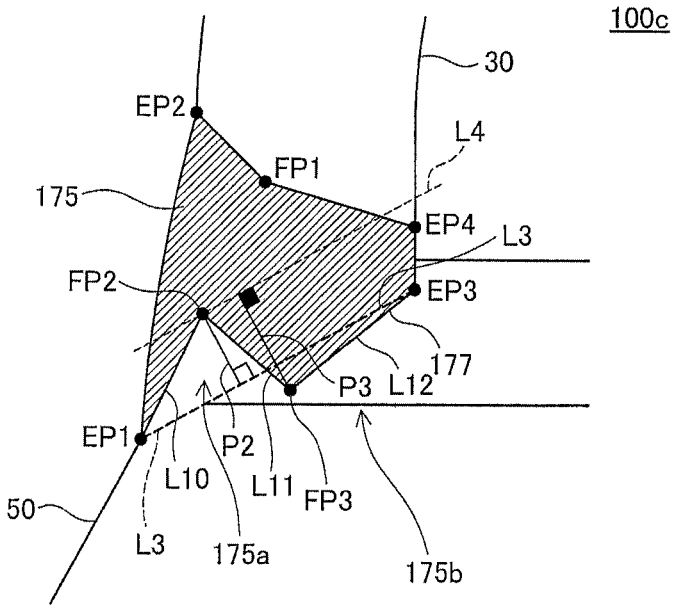
FIG. 12 is an expansion figure of a welded portion between the ground electrode 30 and the metal shell 50 in a third embodiment.

FIG. 12 is an expansion figure of a welded portion between the ground electrode 30 and the metal shell 50 in the third embodiment. Similarly to the first and second embodiments, the ground electrode 30 and the metal shell 50 are joined together via the fusion portion 175. The fusion portion 175 is a portion formed by melting both of the ground electrode 30 and the metal shell 50 using laser beam welding. FIG. 12 illustrates a cross section that includes the center line of the ground electrode 30 and the axis OL, and the cross section is parallel to the axis OL. In the fusion portion 175 of the third embodiment, like reference numerals designate corresponding or identical points throughout the second embodiment and the third embodiment. However, a position of the folding point FP2 is different from the position of the folding point FP2 in the second embodiment.

In the third embodiment, a metal-shell-side melted boundary 177, which is the boundary between the fusion portion 175 and the metal shell 50, is formed of three linear shapes. That is, the metal-shell-side melted boundary 177 coincides with: a line L10 that linearly connects the first end point EP1 and the folding point FP2, a line L11 that linearly connects the folding point FP2 and the folding point FP3, and a line L12 that linearly connects the folding point FP3 and the third end point EP3. In other words, the fusion portion 175 includes: a concave portion 175*a* formed of the line L10 and the line L11 in a concave shape at the ground electrode 30, and a convex portion 175*b* formed of the line L11 and the line L12 in a convex shape at the metal shell 50 side. The boundary between the fusion portion 175 and the ground electrode 30 is the same as that of the first embodiment.

As described in the third embodiment, in the case where the metal-shell-side melted boundary 177 includes a plurality of folding points, the folding points are specified as follows. That is, a folding point of the metal-shell-side melted boundary 177 is a point where a moving direction of a trajectory of the metal-shell-side melted boundary 177 changes. Specifically, the trajectory of the boundary 177 includes: a first straight line (the line L10) representing a trajectory that moves from one end of the metal-shell-side melted boundary 177 as a starting point in a direction separating from the line L3, and a second straight line (the line L11) representing a trajectory that moves in a direction approaching the line L3. A first folding point FP2 is an intersection point where a length of a vertical line P2 from an intersection point between the first straight line and the second straight line to the line L3 is equal to or more than a predetermined length (equal to or more than 0.01 mm in the third embodiment). Subsequently, the second folding point FP3 includes: a third straight line (the line L11) representing a trajectory that passes through an adjacent point (the first folding point FP1 in FIG. 12) and moves from the adjacent point (including a folding point and a point that is not a folding point but changes a moving direction of the trajectory) as a starting point in a direction separating from the line L4 that is a straight line parallel to the line L3, and a fourth straight line (the line L12) representing a trajectory that moves in a direction approaching the line L4. The second folding point FP3 is an intersection point where a length of a vertical line P3 from an intersection point between the third straight line and the fourth straight line to the line L4 is equal to or more than a predetermined length. Similarly, the N-th folding point (N≥3) includes: the M-th straight line (M≥5) representing a trajectory that passes through an adjacent point and moves from the adjacent point as a starting point in a direction separating from (approaching) a virtual straight line parallel to the line L3, and the M+1-th straight line representing a trajectory that moves in a direction approaching (separating from) the virtual straight line. The N-th folding point is an intersection point between the M-th straight line and the M+1-th straight line, and also an intersection point where a length of a vertical line from the intersection point to the virtual straight line is equal to or more than a predetermined length.

C2. Evaluation Result

FIG. 13 illustrates a result of a welding strength evaluation test of the fusion portion 175. In the welding strength evaluation test, samples of the spark plug are prepared. In the samples, a length H of the metal-shell-side melted boundary 177 of the fusion portion 175 and the number of folding points are varied. Regarding the respective samples, a welding strength between the ground electrode 30 and the metal shell 50 was evaluated. Laser beam welding is a welding method of the samples. The thickness A of the fusion portion 175 is 0.2 mm. The thickness C of the ground electrode 30 is 1.5 mm. Sample 19 includes no folding point. Sample 20 includes one folding point, and has the configuration of the spark plug 100*a* illustrated in FIG. 10 described in the second embodiment. Sample 21 includes two folding points, and has a configuration of a spark plug 100*c* illustrated in FIG. 12 in the third embodiment. Sample 22 includes three folding points. The evaluation method of the welding strength is the same as that of the second embodiment.

As illustrated in FIG. 13, in samples 21 and 22 with two or more folding points, evaluation of "excellent" was obtained. That is, it was confirmed that the boundary between the metal shell 50 and the fusion portion 175 in a shape with a plurality of folding points improved a welding strength between the ground electrode 30 and the metal shell 50. This is because, this allows further dispersing a direction of a stress acting the boundary between the fusion portion 175 and the metal shell 50 along with vibration generated by the spark plug 100 in use.

With the spark plug of the third embodiment, the shape of the metal-shell-side melted boundary 177 includes two or more portions of at least one convex portion that is convex at the metal shell 50 side and the concave portion that is concave at the ground electrode side. This further increases the contact area between the metal shell 50 and the fusion portion 175. Accordingly, this further reduces a temperature rise of the fusion portion 175 and further improves the bonding strength between the metal shell 50 and the ground electrode 30.

D. Modification

D1. Modification 1

Figure 14:
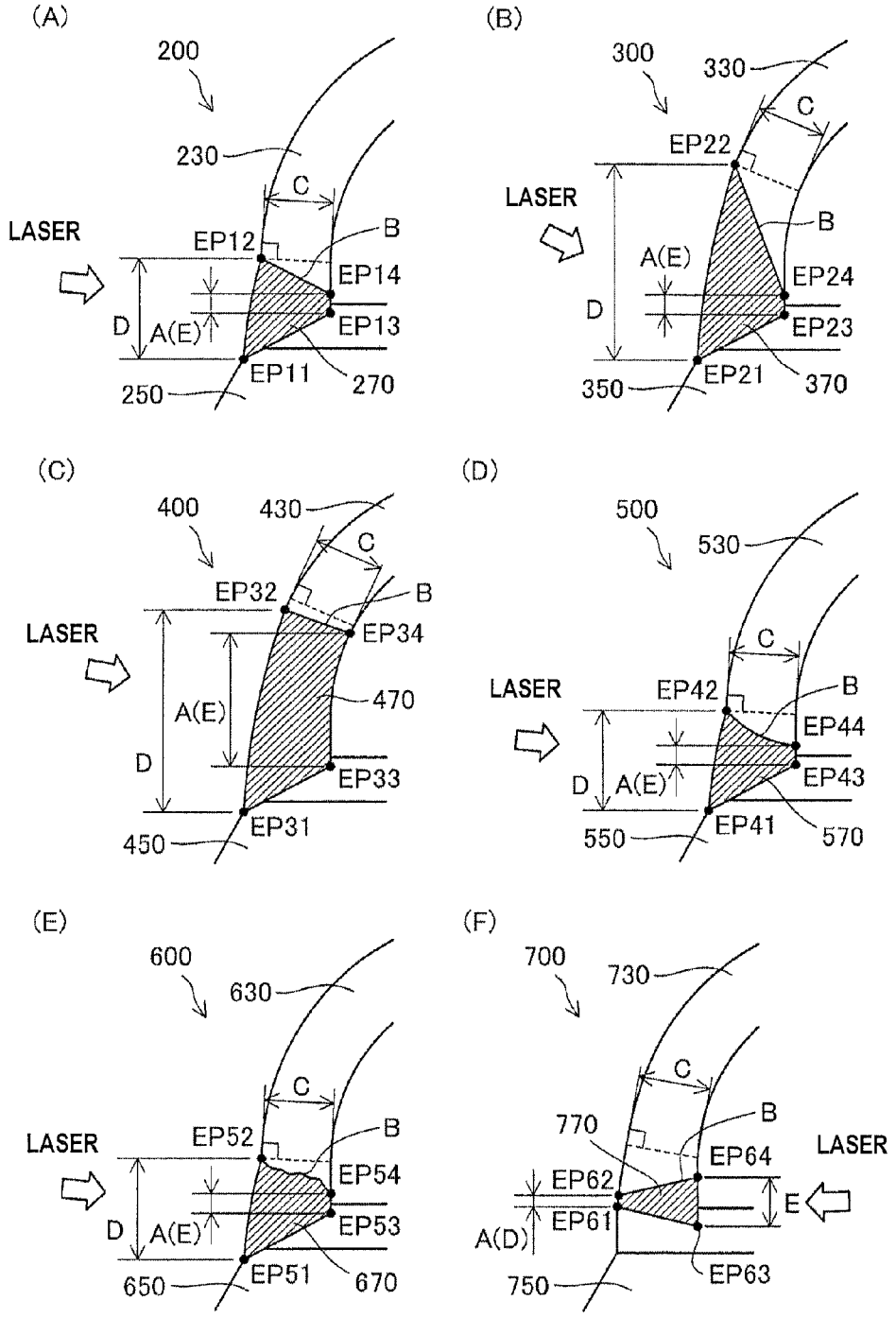
FIG. 14 is an explanatory diagram illustrating a modification of a shape of the fusion portion.

FIG. 14 illustrates a modification of the shape of the fusion portion 70. The shape of the fusion portion 70 is not limited to the shape illustrated in FIG. 2. Any shape may be possible insofar as the shape satisfies the above-described expressions (1) and (2). Regarding the respective components of the spark plugs 200 to 700 as the modification illustrated in FIG. 14, reference numerals attached for respective components corresponding to those of the spark plug 100 as the embodiment are adopted in the last two digits. Additionally, regarding the respective end points illustrated in FIG. 14, reference numerals attached for respective end points corresponding to those of the spark plug 100 are adopted in the last single digit.

For example, as illustrated in FIG. 14(A), the boundary between a ground electrode 230 and a fusion portion 270 (hereinafter also referred to simply as a boundary) may be formed of one linear shape. That is, the boundary may not include a folding point. Additionally, as illustrated in FIG. 14(B), the length D of the fusion portion 370 may be formed larger than that of the spark plug 200 such that the length D becomes considerably larger than the length E. Additionally, as illustrated in FIG. 14(C), the length E of the fusion portion 470 may be slightly smaller than the length D.

As illustrated in FIG. 14(D), the boundary may be formed in an arc shape. Alternatively, as illustrated in FIG. 14(E), the boundary may be formed in a curved shape with a folding point. Additionally, as illustrated in FIG. 14(F), the length D of the fusion portion 770 may be smaller than the length E. While the illustration is omitted, also the shape of the boundary between the fusion portion and the metal shell may be any shape.

In case of the curved shape such as an arc at the boundary of the fusion portion, formation of the boundary of the fusion portion in a concave shape at the ground electrode 30 side means that any point on the boundary excluding both end points is positioned at the ground electrode 30 side with respect to a straight line connecting both end points. Formation of the boundary of the fusion portion formed in a convex shape at the metal shell 50 side means that any point on the boundary excluding both end points is positioned at the metal shell 50 side with respect to a straight line connecting both end points.

In the example of FIG. 14(D), in a cross section of a spark plug 500, a shape of a boundary of a fusion portion 570 at the ground electrode side is a convex shape to a metal shell 550 side. The fusion portion 570 has lower thermal conductivity compared with a base material of the ground electrode 530. Accordingly, in the case where the shape of boundary of the fusion portion 570 at the ground electrode side is a convex shape to the metal shell 550 side, a volume of the base material of the ground electrode 530 with high thermal conductivity becomes larger compared with a case of a concave shape to the ground electrode 30 side. Therefore, in the case where the shape of the boundary of the fusion portion 570 at the ground electrode side is a convex shape to the metal shell 550 side, this shape reduces a temperature of the distal end portion of the ground electrode 530 and inhibits formation of an oxide film on the distal end portion of the ground electrode 530. This is preferred.

Figure 15:
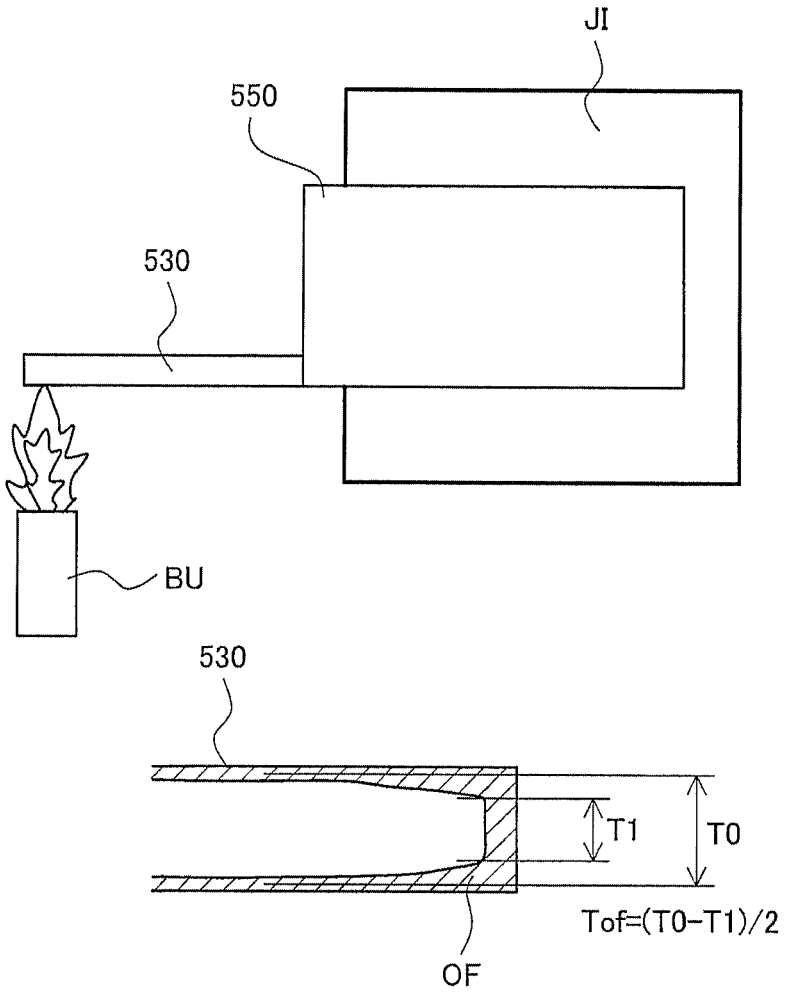
FIG. 15 is an explanatory diagram illustrating an outline of an oxide film formation evaluation test in a distal end portion of a ground electrode 530.

FIG. 15 is an explanatory diagram illustrating an outline of an oxide film formation evaluation test in the distal end portion of the ground electrode 530. FIG. 16 is an explanatory diagram illustrating a result of the oxide film formation evaluation test in the distal end portion of the ground electrode 530. In the oxide film formation evaluation test, the ground electrode 530 (with a cross section dimension of 1.5 mm×2.8 mm and a length of 10 mm) made of nickel alloy is joined to the metal shell 550. The metal shell 550 joined to the ground electrode 530 is secured to a water cooling tool JI. Additionally, the metal shell 550 is always water cooled by the water cooling tool JI. In this state, 1000 sets of: a process where the distal end portion of the ground electrode 530 is heated for two minutes by a burner BU such that a temperature of the fusion portion 570 (a base end of the ground electrode 530) becomes 300 degrees Celsius; and a process where the burner BU is turned off to perform slow cooling for one minute were repeated. Subsequently, a generating condition of the oxide film OF in the cross section of the ground electrode 530 was observed. Specifically, a thickness T0 of the ground electrode 530 before the test and a thickness T1 of a non-oxidized portion in the ground electrode 530 after the test were used to calculate an oxide film thickness Tof=((T0−T1)/2). If the oxide film thickness Tof is equal to or less than 0.1 mm, the result was judged as "good". If the oxide film thickness Tof exceeded 0.1 mm, the result was judged as "poor".

As illustrated in FIG. 16, in the case where the shape of the boundary of the fusion portion 570 at the ground electrode side was a convex shape to the metal shell 550 side, the oxide film thickness Tof was 0.06 mm and judged as "good". On the other hand, in the case where the shape of the boundary of the fusion portion 570 at the ground electrode side was a flat shape or a concave shape to the ground electrode 530 side, the oxide film thickness Tof exceeded 0.1 mm in both cases and judged as "poor". If the shape of the boundary of the fusion portion 570 at the ground electrode side is a convex shape to the metal shell 550 side, this shape inhibits formation of the oxide film on the distal end portion of the ground electrode 530. This effect is provided not only in ease of the boundary of the fusion portion in an arc shape but similarly provided in case of the boundary of the fusion portion by a straight line and a curved line other than the arc.

Figure 17:
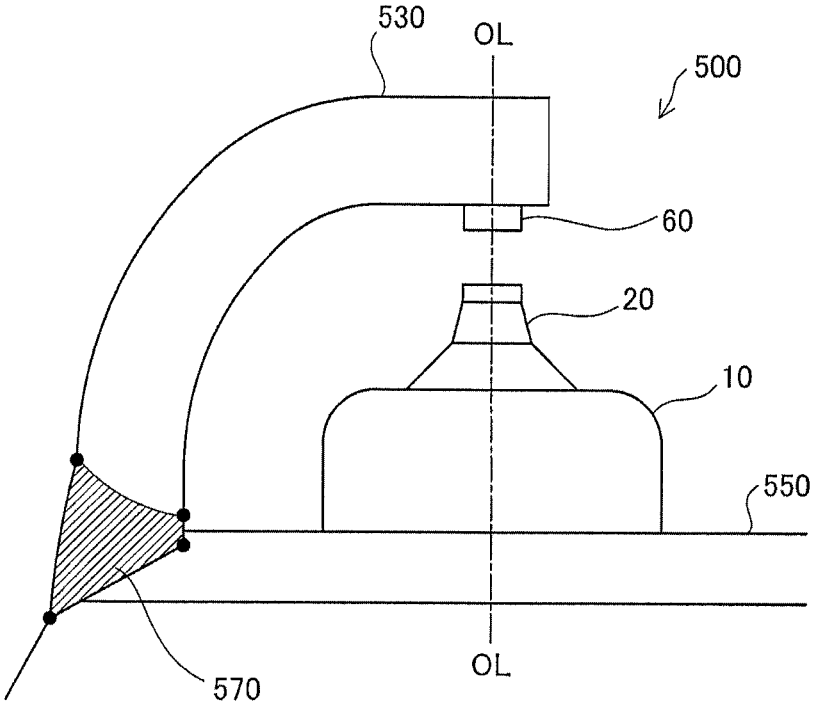
FIG. 17 is an explanatory diagram illustrating a modification where a noble metal tip 60 is joined to the distal end portion of the ground electrode 530 in the spark plug 500 illustrated in FIG. 14(D).

In the above-described embodiments or the modification, at a position (a position where a discharge gap is formed) of the distal end portion of the ground electrode facing the center electrode, a noble metal tip may be joined. FIG. 17 is an explanatory diagram illustrating a modification where a noble metal tip 60 is joined to the distal end portion of the ground electrode 530 in the spark plug 500 illustrated in FIG. 14(D). The noble metal tip 60 is joined to the ground electrode 530 by, for example, resistance welding. Existence of the noble metal tip 60 improves resistance to spark erosion and to oxidative consumption of the ground electrode 530.

As illustrated in FIG. 17, if the shape of the boundary of the fusion portion 570 at the ground electrode side is a convex shape to the metal shell 550 side, as described above, this shape reduces the temperature of the distal end portion of the ground electrode 530. Accordingly, this reduces a drop in bonding durability of the noble metal tip 60.

Figure 18:
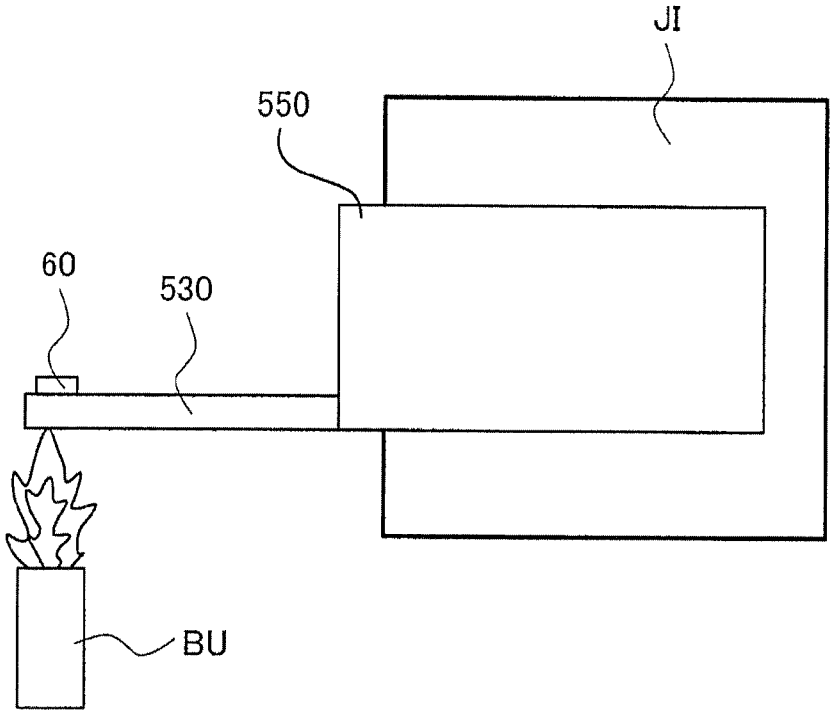
FIG. 18 is an explanatory diagram illustrating an outline of a bonding durability evaluation test on the noble metal tip 60.

FIG. 18 is an explanatory diagram illustrating an outline of a bonding durability evaluation test on the noble metal tip 60. Additionally, FIG. 19 is an explanatory table illustrating a result of the bonding durability evaluation test on the noble metal tip 60. In the bonding durability evaluation test of the noble metal tip 60, the ground electrode 530 (with the cross section dimension of 1.5 mm×2.8 mm and the length of 10 mm, and joined with a noble metal (platinum) tip 60 having a diameter of 1.0 mm in a position at 1 mm from a tip end by resistance welding) made of INC600 is joined to the metal shell 550. The metal shell 550 joined to the ground electrode 530 is secured to the water cooling tool JI. Subsequently, the metal shell 550 is kept cooled by the water cooling tool JI. In this state, a set of: a process where the distal end portion of the ground electrode 530 is heated for two minutes by a burner BU such that a temperature of the fusion portion 570 (a base end of the ground electrode 530) becomes 300 degrees Celsius; and a process where the burner BU is turned off to perform slow cooling for one minute were repeated 1000 times. Subsequently, a joined state of the noble metal tip 60 in the cross section of the ground electrode 530 was observed. Specifically, existence of a crack in the joined portion was examined.

As illustrated in FIG. 19, in the case where the shape of the boundary of the fusion portion 570 at the ground electrode side is a convex shape to the metal shell 550 side, it was judged that a crack did not exist. On the other hand, in the case where the shape of the boundary of the fusion portion 570 at the ground electrode side was a flat shape or a concave shape to the ground electrode 530 side, it was judged that a crack existed. Accordingly, if the shape of the boundary of the fusion portion 570 at the ground electrode side is a convex shape to the metal shell 550 side, a drop in bonding durability of the noble metal tip 60 is reduced. This effect is provided not only in case of the boundary of the fusion portion in an arc shape but similarly provided in case of the boundary of the fusion portion by a straight line and a curved line other than the arc.

D2. Modification 2

The material of the ground electrode 30 is not limited specifically, and may adopt noble metal or alloy containing noble metal. This noble metal may adopt platinum (Pt), iridium (Ir), ruthenium (Ru), rhodium (Rh), palladium (Pd), and gold (Au). This improves durability of the ground electrode 30. Adopting laser beam welding allows preferable welding of the ground electrode 30 made of noble metal or noble metal alloy. Also, the shape of the ground electrode 30 is not limited specifically. For example, the rod-shaped electrode member may adopt what is called a ground electrode in an oblique ground electrode type welded to the metal shell in a state inclined by an intersecting angle less than 90° with the axis OL. Also regarding this type of ground electrode, adopting laser beam welding ensures a preferable welding.

D3. Modification 3

A method for welding the ground electrode 30 and the metal shell 50 is not limited to laser beam welding, and any welding method may be adopted for forming the above-described shape of the fusion portion 70. For example, electron beam welding may be adopted.

D4. Modification 4

The ground electrode 30 is not limited to a single layer construction, and may be a multi-layer construction with two or more layers. For example, the ground electrode 30 may be constituted by two layers of a surface layer and a core material formed inside of the surface layer. The core material may employ a material with thermal conductivity larger than that of the surface layer. For example, the surface layer may adopt Ni-based heat-resistant alloy while the core material may adopt pure copper or copper alloy. Alternatively, the core material may be constituted by two layers while the ground electrode 30 may be constituted by three layers. In this case, a second core material formed relatively outside may employ a material with higher thermal conductivity and lower hardness compared with a first core material formed relatively on the inside. For example, the first core material may adopt Ni while the second core material may adopt copper.

Similarly to these configurations, in case of the ground electrode 30 in a multi-layer construction, any material in the respective layers constituting the ground electrode workpiece W30 may be selected as a material with a higher melting point compared with the material of the metal shell workpiece W50. Accordingly, satisfying the above-described expression (4) provides efficiency similar to the efficiency illustrated in FIG. 9.

D5. Modification 5

While in the second embodiment and the third embodiment the metal-shell-side melted boundary 172 is constituted by a plurality of straight lines and all intersection points among the respective straight lines are folding points, the metal-shell-side melted boundary 172 may include a point that is not a folding point and a part of the line L3. Additionally, the metal-shell-side melted boundary 172 is not limited to be formed by only straight lines, and may be, for example, formed by only curved lines or formed by combination of a straight line and a curved line. The metal-shell-side melted boundary 172 may be achieved in various embodiments.

While the embodiments of the present invention have been described above, the present invention is not limited to these embodiments. The present invention may be practiced in various forms without departing from the scope of the invention. For example, the components in each application example and the elements in the embodiments described above may be, as necessary, combined, omitted, or generalized in an embodiment that can solve at least a part of the problems of this application or an embodiment that provides at least a part of the respective efficiencies described above.

DESCRIPTION OF REFERENCE NUMERALS

3: ceramic resistor
4: seal body
5: gasket
10: insulator
12: shaft hole
13: insulator nose length portion
17: tip-end-side trunk portion
18: rear-end-side trunk portion
19: center trunk portion
20: center electrode
21: electrode base metal
25: core material
30, 30*a*, 230, 330, 430, 530, 630, 730: ground electrode
40: terminal electrode
50, 50*a*: metal shell
51: tool engagement portion
52: mounting screw portion
53: crimp portion
54: seal portion
57: distal end face
60: noble metal tip
W30: ground electrode workpiece
W50: metal shell workpiece
W57: distal end face
70, 270, 370, 470, 570, 670, 770: fusion portion
100, 100*a*, 200, 300, 400, 500, 600, 700: spark plug
150: engine head
151: mounting screw hole
EP1, EP1*a*, EP11, EP21, EP31, EP41, EP51, EP61: first end point
EP2, EP12, EP22, EP32, EP42, EP52, EP62: second end point
EP3, EP3*a*, EP13, EP23, EP33, EP43, EP53, EP63: third end point
EP4, EP14, EP24, EP34, EP44, EP54, EP64: fourth end point
FP1: folding point
SG: spark gap
OL: axis

The invention claimed is:

1. A spark plug, comprising:

a rod-shaped center electrode that extends in an axial direction;

an insulator with a shaft hole that extends in the axial direction, the insulator holding the center electrode inside of the shaft hole;

a metal shell that surrounds and holds a part of the insulator in a circumferential direction; and a ground electrode that includes a base end welded to the metal shell, wherein the metal shell and the ground electrode are joined via a fusion portion, the fusion portion being formed by melting both the ground electrode and the metal shell together by welding, an end face of the base end of the ground electrode is melted entirely, and when a smallest thickness of the fusion portion in the axial direction is A, said smallest thickness being provided at a side of the fusion portion facing the center electrode;

when, in a cross section that includes a center line of the ground electrode and the axis, and is parallel to the axis, a length of a ground-electrode-side melted boundary is B, said boundary being formed between the fusion portion and the ground electrode; and when a thickness of the ground electrode is C, conditions of A≥0.2 mm and B>C are satisfied.

2. The spark plug according to claim 1, wherein in the cross section, a shape of the ground-electrode-side melted boundary includes any of a curved line, a plurality of straight lines, and a combination of a curved line and a straight line.

3. The spark plug according to claim 1, wherein in the cross section, when a length between a first end point and a second end point in an axial direction is D, the first end point being an end point on an opposite side of the center electrode at a metal-shell-side melted boundary formed between the fusion portion and the metal shell, the second end point being an end point on an opposite side of the center electrode at the ground-electrode-side melted boundary; and when a length between a third end point and a fourth end point in the axial direction is E, the third end point being an end point on a side of the center electrode side at the metal-shell-side melted boundary, the fourth end point being an end point on a side of the center electrode side at the ground-electrode-side melted boundary, a condition of D>E is satisfied.

4. The spark plug according to claim 1 wherein in the cross section, a shape of the metal-shell-side melted boundary includes any of a curved line, a plurality of straight lines, and a combination of a curved line and a straight line.

5. The spark plug according to claim 4, wherein in the cross section, the shape of the ground-electrode-side melted boundary is a convex shape to the metal shell side.

6. The spark plug according to claim 5, wherein a noble metal tip is joined to a distal end portion of the ground electrode.

7. The spark plug according to claim 4, wherein the shape of the metal-shell-side melted boundary in the cross section includes at least two or more portions, said portions including both or either of a convex portion that is convex to the metal shell side and/or a concave portion that is concave to the ground electrode side.

8. The spark plug according to claim 1, wherein the ground electrode is formed of noble metal or alloy containing noble metal.

9. A method for manufacturing the spark plug according to claim 1, comprising the steps of:

preparing a metal shell workpiece that becomes a metal shell after welding;

preparing a ground electrode workpiece that becomes a ground electrode after welding; and welding the metal shell workpiece and the ground electrode workpiece, wherein the ground electrode workpiece has a higher melting point than a melting point of the metal shell workpiece, and in the cross section, when a thickness of the ground electrode workpiece is F; and when a thickness of an end face of the metal shell workpiece at a side welded to the ground electrode workpiece is G, a condition of F>G is satisfied.

* * * * *